US006816171B2

(12) United States Patent
Kim

(10) Patent No.: US 6,816,171 B2
(45) **Date of Patent: *Nov. 9, 2004**

(54) DEVICE FOR AUTOMATICALLY CONTROLLING IMAGES ON FLAT PANEL DISPLAY AND METHODS THEREFOR

(75) Inventor: Young-Chan Kim, Anyang-si (KR)

(73) Assignee: Samsung Electronics Co., Ltd., Suwon-si (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/236,402

(22) Filed: Jan. 25, 1999

(65) Prior Publication Data

US 2002/0067351 A1 Jun. 6, 2002

(30) Foreign Application Priority Data

Jan. 24, 1998 (KR) ..... 98-2187

(51) Int. Cl.[7] ..... G09G 5/00; G09G 5/02

(52) U.S. Cl. ..... 345/699; 345/698; 345/3.3; 345/3.4

(58) Field of Search ..... 345/127, 129, 345/130, 132, 698, 699, 3.3–3.4, 204, 213, 214, 716

(56) References Cited

U.S. PATENT DOCUMENTS 5,926,174 A * 7/1999 Shibamiya et al. ..... 345/213
6,037,925 A * 3/2000 Kim ..... 345/132
6,078,361 A * 6/2000 Reddy ..... 348/558
6,097,437 A * 8/2000 Hwang ..... 345/132

* cited by examiner

*Primary Examiner*—Regina Liang
*Assistant Examiner*—Duc Q Dinh
(74) *Attorney, Agent, or Firm*—Staas & Halsey LLP

(57) ABSTRACT

A device for receiving video signals and horizontal and vertical synchronizing signals using a flat panel display device for discriminating modes thereof. The device displays the best images by automatically controlling the mode, in case the mode is unsuitable for the flat panel and a method therefor. A micro-controller discriminates modes according to the input horizontal and vertical synchronizing signals and outputs an OSD (on screen display) control signal and pixel clock control signals according to the discriminated modes. A phase-locked loop controls timing of pixel clocks according to the pixel clock signals control of the micro-controller and outputs the pixel clocks. An analog to digital converter receives video signals, and samples the video signals according to the pixel clocks from the phase-locked loop and converts the video signals into digital video signals. A video controller receives the digital video signals transmitted from the analog-digital converter and outputs the digital video signals to a panel driver according to the pixel clocks and the OSD control signal.

23 Claims, 9 Drawing Sheets

16a

| | | | | | | |
|---|---|---|---|---|---|---|
| Column (0) Row (0) | Column (1) Row (0) | Column (2) Row (0) | . . . | Column (max−1) Row (0) | Column (max) Row (0) |
| Column (0) Row (1) | Column (1) Row (1) | Column (2) Row (1) | . . . | Column (max−1) Row (1) | Column (max) Row (1) |
| . . . | . . . | . . . | | . . . | . . . |
| Column (0) Row (max−1) | Column (1) Row (max−1) | Column (2) Row (max−1) | . . . | Column (max−1) Row (max−1) | Column (max) Row (max−1) |
| Column (0) Row (max) | Column (1) Row (max) | Column (2) Row (max) | . . . | Column (max−1) Row (max) | Column (max) Row (max) |

FIG. 2

FIG. 3A
FIG. 3B
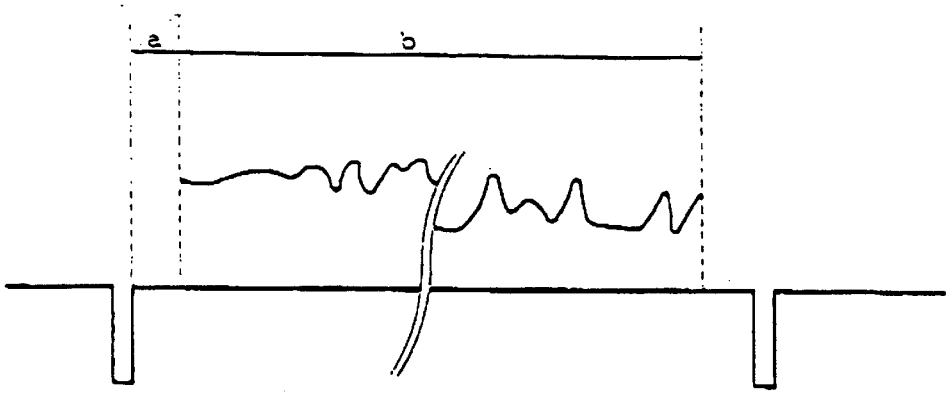
FIG. 3C
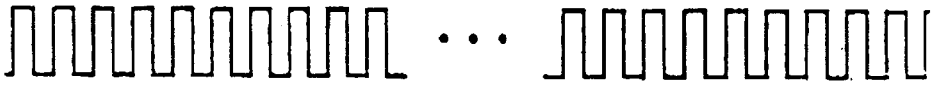
FIG. 3D
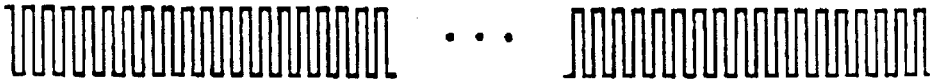
FIG. 3E
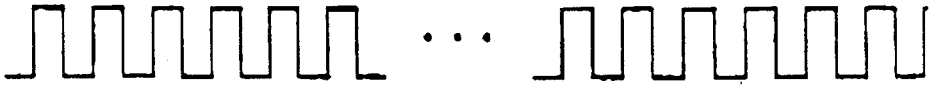

FIG. 4

16a

| LINE MEMORY | Case 1 | Case 2 | Case 3 |
|---|---|---|---|
| Column (0) | 0 | 0 | 0 |
| Column (1) | 0 | 0 | 0 |
| Column (2) | 0 | 0 | 0 |
| Column (3) | 0 | 0 | XX |
| Column (4) | 0 | 0 | XX |
| Column (5) | XX | 0 | XX |
| Column (6) | XX | 0 | XX |
| Column (7) | XX | XX | XX |
| Column (8) | XX | XX | XX |
| ⋮ | | | |
| Column (max-16) | XX | XX | XX |
| Column (max-15) | XX | XX | XX |
| Column (max-14) | XX | XX | XX |
| Column (max-13) | XX | XX | 00 |
| Column (max-12) | XX | XX | 00 |
| Column (max-11) | XX | XX | 00 |
| Column (max-10) | XX | XX | 00 |
| Column (max-9) | XX | XX | 00 |
| Column (max-8) | XX | XX | 00 |
| Column (max-7) | XX | XX | 00 |
| Column (max-6) | XX | XX | 00 |
| Column (max-5) | XX | XX | 00 |
| Column (max-4) | XX | XX | 00 |
| Column (max-3) | 00 | XX | 00 |
| Column (max-2) | 00 | XX | 00 |
| Column (max-1) | 00 | XX | 00 |
| Column (max) | 00 | XX | 00 |

DEVICE FOR AUTOMATICALLY CONTROLLING IMAGES ON FLAT PANEL DISPLAY AND METHODS THEREFOR

CLAIM OF PRIORITY

This application makes reference to, incorporates the same herein, and claims all benefits accruing under 35 U.S.C. §119 from my application entitled Auto Control Apparatus For The Image On Flat Panel Display and Method Thereof filed with the Korean Industrial Property Office on 24, Jan. 1998 and there duly assigned Serial No. 98-02187 by that Office.

BACKGROUND OF THE INVENTION

1. Field of the Invention

The present invention relates to a device and method for automatically controlling images on a flat panel display, and more particularly, to a device and method for displaying the best images by automatically controlling a mode, in case the mode is unsuitable for the flat panel.

2. Description of the Related Art

A plasma display panel (abbreviated to PDP hereafter), a liquid crystal display (abbreviated to LCD hereafter) and a light emitting diode display (abbreviated to LED hereafter) belong to the family of flat panel display devices. Among the displays, the LCD, which is generally utilized, is used as a display for a portable terminal as well as for a desktop computer. The PDP is being developed as a display for television broadcasts.

The flat panel display receives image signals and horizontal and vertical synchronizing signals from a host. The received image signals are synchronized by the flat panel display according to the horizontal and vertical synchronizing signals and displayed thereby. At this time, the image signals generated from the host can have various types of modes according to video cards equipped in the host. For instance, a preset mode of the flat panel display is stored for the image signals by setting various parameters; such as horizontal and vertical positions and sizes.

Accordingly, the flat panel display displays the images employing the parameters nearest to the preset mode, which may be unsuitable for the flat panel display. This causes a distortion of images because timing of the horizontal and vertical synchronizing signals generating from the host is not suitable for the flat panel display. In order to compensate for the distortion, conventionally, a user has to adjust the image distortion, which is outside the flat panel display.

SUMMARY OF THE INVENTION

Accordingly, to overcome such drawbacks present in the conventional art the present invention provides a devices and a method therefor for receiving video signals and horizontal and vertical synchronizing signals using a flat panel display device, for discriminating modes thereof, and for displaying the best images. The device automatically controls a mode of the video, signal and in particular, in the case that the mode is unsuitable for the flat panel.

Additional objects and advantages of the invention will be set forth in part in the description which follows and, in part, will be obvious from the description, or may be learned by practice of the invention. device for automatically controlling images of a flat panel display, the a device including a micro-controller for discriminating modes according to input horizontal and vertical synchronizing signals, and for outputting an OSD (on screen display) signal and pixel clock control signals according to the discriminated modes, a phase-locked loop for controlling timing of pixel clocks according to the pixel clock control signals of the micro-controller, an analog to digital converter for receiving video signals, for sampling the video signals according to the pixel clocks from the phase-locked loop, for converting the video signals into digital video signals, and a video controller for receiving the digital video signals transmitted from the analog-digital converter, for outputting the digital video signals to a panel driver according to the pixel clocks from the phase-locked loop and the OSD control signal offered from the micro-controller.

According to another aspect of the present invention, a method for automatically controlling images of a flat panel display, the method including checking whether an input mode is a first preset mode after discriminating a mode of received horizontal and vertical synchronizing signals, driving another preset mode nearest to the input mode in case the input mode is not the first preset mode, controlling a horizontal parameter according to the input mode in response to the nearest mode being driven, and controlling a vertical parameter when the horizontal parameter is controlled.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein:

FIG. 2 is a view of a memory map of a video controller of the inner circuit of FIG. 1;

FIGS. 3A through 3E are waveform views of video signals, horizontal and vertical synchronizing signals, and a pixel clock output from a PLL of the inner circuit of FIG. 1;

FIG. 4 is a view of a column memory map illustrating a memory status of image data according to pixel clocks of the inner circuit of FIG. 3;

DESCRIPTION OF THE PREFERRED EMBODIMENT

The present invention will be apparent from the following description in conjunction with the accompanying drawings.

Figure 1:
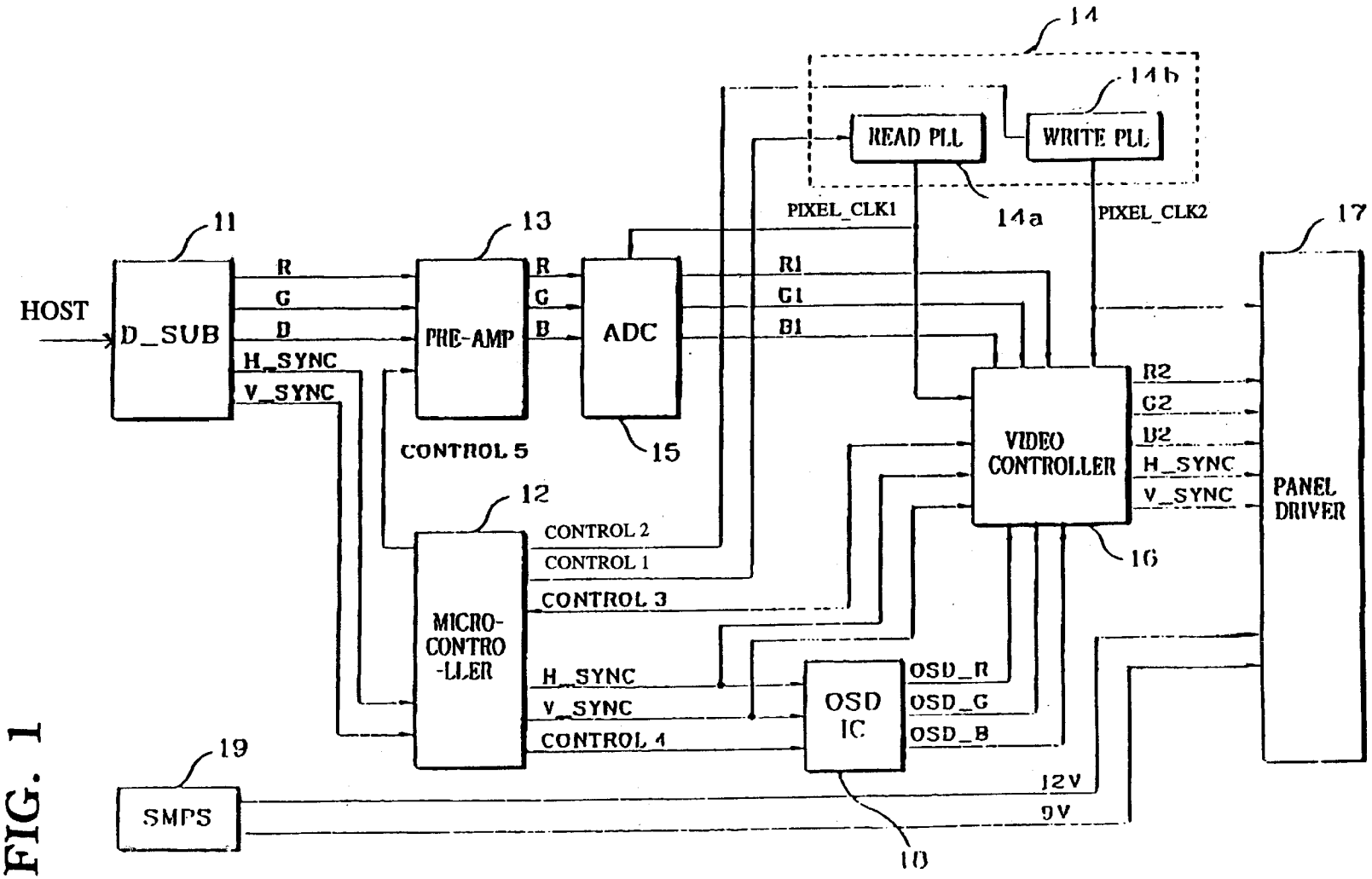
FIG. 1 is a block view illustrating a construction of an inner circuit of a flat panel display in accordance with the present invention.

In accordance with the present invention, FIG. 1, shows a device for automatically controlling images of a flat panel display including a micro-controller 12 for discriminating modes according to input horizontal and vertical synchronizing signals (H_SYNC and V_SYNC), and for generating a control signal (CONTROL 4). The micro-controller 12 generates pixel clock control (CONTROL 1, CONTROL 2) signals according to the discriminated modes. An OSD IC 18 (on screen display integrated circuit) generates OSD signals (OSD-R, OSD-G, OSD-B) to a video controller 16. A loop 14 controls timing of pixel clocks according to the pixel clock control signals (CONTROL 1, CONTROL 2) of the micro-controller 12. An analog to digital converter (ADC) 15 receives video signals (R, G, B), for sampling the video signals (R, G, B) according to the timing of the pixel clock (PIXEL_CLK1) from the phase-locked loop 14, and converts the video signals into digital video signals (R1, G1, B1). A video controller 16 receives the digital video signals transmitted from the analog-digital converter, 15 and outputs the digital video signals to a panel driver 17 according to the pixel clocks (PIXEL_CLK1, PIXEL_CLK2) from the phase-locked loop 14 and the control signals from the micro-controller 12.

Further, the device for automatically controlling images according to the embodiment of the present invention can be described in detail as follows.

The flat panel display receives the video signals (R, G, B) and the horizontal and vertical synchronizing signals (H_SYNC, V_SYNC) from a host, discriminates between modes, and controls and displays images according to the modes respectively. A D_SUB (D-shaped connector) 11, within the flat panel display, receives the video signals (R, G, B) and the horizontal and vertical synchronizing signals (H_SYNC, V_SYNC) from the host. The micro-controller 12 receives the horizontal and vertical synchronizing signals (H_SYNC, V_SYNC) transmitted from the D_SUB 11. The micro-controller 12 counts the received horizontal and vertical synchronizing signals (H_SYNC, V_SYNC) using horizontal and vertical register counters (not illustrated) therein. The micro-controller 12 discriminates the modes of the video signals (R, G, B) transmitted to the flat panel display according to the counted result. The device for automatically controlling images includes a memory device (not shown) which stores a plurality of predetermined factory mode values (preset modes) and has room for storing user-defined modes. When the mode suitable to the flat panel (not illustrated) is received, the micro-controller 12 drives a preset mode which is set as one of the stored factory modes. On the contrary, when a mode unsuitable to the flat panel (not illustrated) is received, the micro-controller 12 drives a second preset mode nearest to the received mode. When the second preset mode nearest to the preset mode is driven, the horizontal and vertical parameters of the images are controlled according to the second mode.

The micro-controller 12 outputs first, second, third control signals (CONTROL 1, 2, 3) to control the horizontal and vertical parameters. In addition, the micro-controller 12 outputs the information for controlling the images according to the mode by generating a fourth control signal (CONTROL 4) as an OSD (on screen display) control signal and a fifth control signal (CONTROL 5) as a clamping control signal for determining an amplifying level of the video signals. A preamplifier 13 receives the fifth control signal (CONTROL 5). The preamplifier 13 receives, amplifies, and outputs the video signals (R, G, B) transmitted from the D-SUB 11 according to the fifth control signal (CONTROL 5). The ADC 15 converts the analog video signals (R, G, B) into first data which are the digital video signals (R1, G1, B1) and outputs the first data according to a sampling period of the pixel clock (PIXEL_CLK1) being output from a read PLL (phase-locked-loop) 14*a* of the PLL 14. The pixel clock (PIXEL_CLK1) is locked in and output according to the first control signal (CONTROL 1). The first control signal (CONTROL 1) is a control signal for controlling the timing of the pixel clock (PIXEL_CLK1) being output from the read PLL 14*a*. The second control signal (CONTROL 2) is a control signal for controlling timing of a pixel clock (PIXEL_CLK2) being output from the write PLL 14*b*.

The first data (R1, G1, B1) are stored in the video controller 16 by the pixel clock (PIXEL_CLK2). The video controller 16 stores the first data (R1, G1, B1) in a line memory 16*a* (shown in FIG. 2), according to the pixel clock (PIXEL_CLK) being output from the read PLL 14*a*. The line memory 16*a*, as shown in FIG. 2, is constituted by a matrix having columns (0 to Nth) and rows (0 to Nth). The line memory 16*a* stores the first data (R1, G1, B1) transmitted from the ADC 15 in order.

The sizes of the first data (R1, G1, B1) which are adjusted according to the mode discriminated in the micro-controller 12. The sizes of the images of the first data (R1, G1, B1) are adjusted suitably for the modes in the process of being sampled by the ADC 15. That is illustrated more concretely in FIG. 3A through FIG. 4.

FIG. 3A shows the waveforms which are video signals (R, G, B) transmitted to the flat panel display device. The video signals (R, G, B) are received for a period of the horizontal synchronizing signal (H_SYNC) illustrated in FIG. 3B. The video signals (R, G, B) received for a period of the horizontal synchronizing signal (H_SYNC) are divided into an offset area (a) of the horizontal and vertical synchronizing signals (H_SYNC, V_SYNC), in which the level of the video signals (R, G, B) becomes '0', and an active area (b) of actual video signals (R, G, B). The video signals (R, G, B) of the active area (b) are sampled by the ADC 15 according to the timing of the same pixel clocks as shown in FIGS. 3C through 3E.

Assuming that the video signals (R, G, B) sampled by the waveform shown in FIG. 3D are preset, the waveform shown in FIG. 3C indicates a slower timing than the waveform shown in FIG. 3D, and the waveform shown in FIG. 3E has a pixel clock which has a slower timing than the waveform shown in FIG. 3C. FIG. 4 shows how the first data (R1, G1, B1) sampled by each of the waveforms shown in FIGS. 3C through 3E are stored in the address of the column of the line memory 16*a*. FIG. 4 shows how the first data (R1, G1, B1) are stored in address of columns of cases (case 1, 2, 3), respectively. Accordingly, the data stored in the addresses of the columns of the line memory 16*a* are displayed on the basis of the waveform shown in FIG. 3D by repeatedly adding or deleting the sampling pixel clocks at the sampling time.

For example, if the flat panel has a resolution of 1204×768 and the now received mode has a resolution of 800×600, the resolution can be adjusted to (800+a)×(600+b) by repeatedly adding the data for a determined period. In this instance, "a" represents the number of the data being read in a blanking period and "b" represents the number of the data being driven in a blanking period. On the contrary, if the flat panel has the resolution of 800×600 and the now received mode has the resolution of 1204×768, the resolution can be adjusted to (800−a)×(600−b) by repeatedly deleting the data for a determined period.

If the resolution, that is the size of images, is adjusted suitably for the flat panel, the position of the images is also adjusted. The video controller 16 transmits the address position of the first data (R1, G1, B1) stored in the line memory 16*a* to the micro-controller 12. Values of the left, right, top, and bottom end registers (not illustrated) are transmitted to the micro-controller 12 according to the positions of the first data (R1, G1, B1) stored in the line memory 16*a* respectively. The micro-controller 12 generates and outputs the third control signal (CONTROL 3) to control the begin and end positions for displaying the first data (R1, G1, B1) to the flat panel according to the values of the transmitted registers, respectively. The micro-controller 12 calculates the begin and end positions for displaying the first data to the flat panel according to the values of the transmitted registers respectively transmitted from the video controller 16 in the storing state of the displaying position of the flat panel.

The video controller 16 receives the third control signal (CONTROL 3) output from the micro-controller 12 and outputs second data (R2, G2, B2), in which the displaying position of the stored first data (R1, G1, B1) has been adjusted. In the third control signal (CONTROL 3), the control signals for adjusting positions of images as well as colors are included. The video controller 16 generates the second data (R2, G2, B2). The video controller 16 receives the pixel clock (PIXEL_CLK1) output from the read PLL 14*a* and outputs the second data (R2, G2, B2) according to the received pixel clock (PIXEL_CLK1).

The second data (R2, G2, B2) is transmitted by the panel driver 17 to the flat panel. The panel driver 17 receives the horizontal and vertical synchronizing signals output through the micro-controller 12 and the video controller 16 and displays the second data (R2, G2, B2) on the flat panel. At this time, the second data (R2, G2, B2) is not at a strong enough level for being displayed on the flat panel. Thus, the panel driver 17 receives driving power (12V, 9V) from a switching made power supply 19 for amplifying the second data (R2, G2, B2) to a sufficient level. The panel driver 17 adjusts and displays the mode adjusted for the flat panel by amplifying the second data (R2, G2, B2) to a level sufficient to display the second data on the flat panel.

Further, the OSD IC 18 displays information for image adjustment. In order to display information for image adjustment, the OSD IC 18 receives the fourth control signal (CONTROL 4) and the horizontal and vertical synchronizing signals (H_SYNC, V_SYNC) from the micro-controller 12. Then, the OSD IC 18 stores the fourth control signal (CONTROL 4) according to the timing of the received horizontal and vertical synchronizing signals (H_SYNC, V_SYNC). The stored fourth control signal (CONTROL 4) is converted into OSD data (OSD_R, OSD_G, OSD_B) when a user chooses it. The outputted OSD data (OSD_R, OSD_G, OSD_B) are received by the video controller 16. The video controller 16 updates the first data (R1, G1, B) stored in the storing position of the received OSD data (OSD_R, OSD_G, OSD_B) and transmits the first data to the panel driver 17. The panel driver 17 drives and displays the OSD data (OSD_R, OSD_G, OSD_B) on the flat panel, and displays the now adjusted image information.

The control program of the micro-controller 12 can be considered in detail in conjunction with the accompanying drawings as follows.

Figure 5:
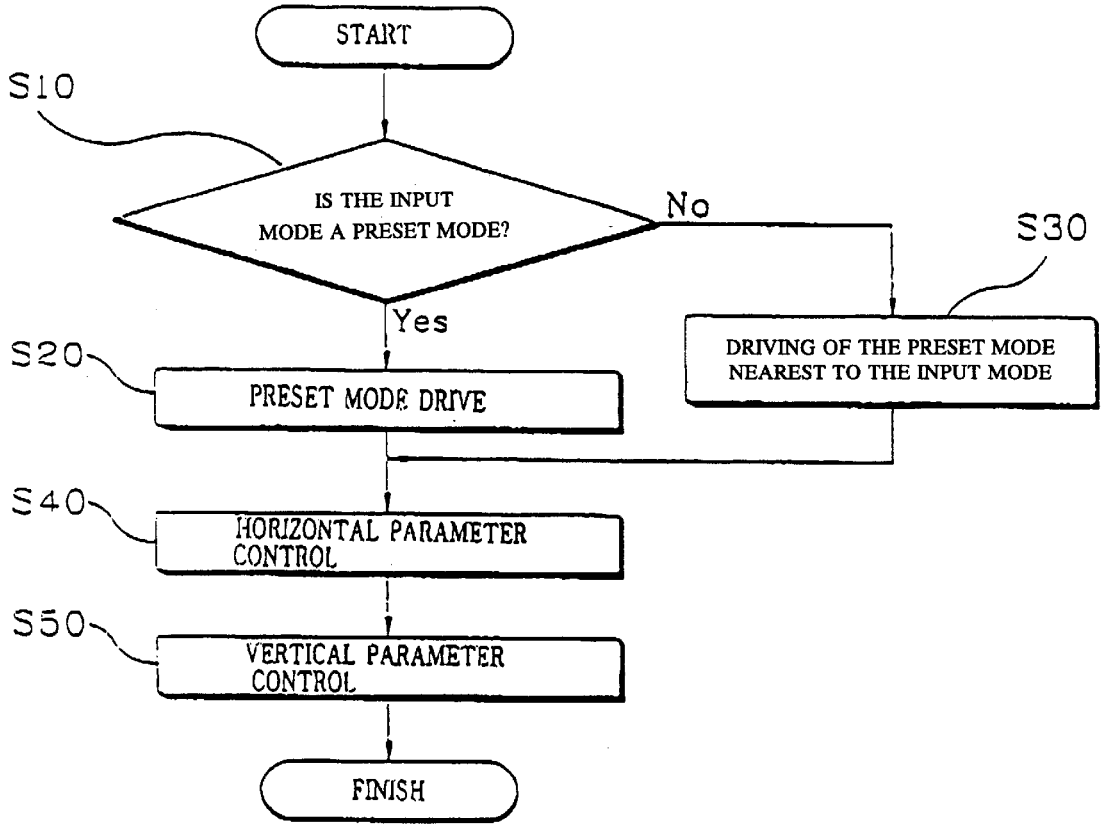
FIG. 5 is a flow chart diagram illustrating a method of automatically controlling images of the flat panel display in accordance with the present invention.

As shown in FIG. 5, a method of automatically controlling images of a flat panel display includes the steps of: checking (S10) whether an input mode is a preset mode after discriminating a mode of the received horizontal and vertical synchronizing signals; driving (S20) the preset mode in the case that the input mode is the preset mode in the checking step (S10); driving (S30) another preset mode nearest to the input mode in the case that the input mode is not the preset mode in the checking step (S10); controlling (S40) a horizontal parameter according to the input mode when the nearest preset mode is driven in the driving step (S30) after driving the present mode in the driving step (S20); and controlling (S50) a vertical parameter should the horizontal parameter be controlled in the controlling step (S40).

The method described above can be considered more concretely as follows. the method checked (S10) whether an input mode is a preset mode after discriminating a mode of the horizontal and vertical synchronizing signals received by the micro-controller 12. In the case that the input mode is the preset mode, the video signals (R, G, B) received according to the preset mode are displayed (S20). On the contrary, in the case that the input mode is not a preset mode, another preset mode nearest to the input mode is driven (S30). After the nearest preset mode is driven and the present mode is driven, the horizontal parameter according to the input mode is controlled (S40).

Figure 6:
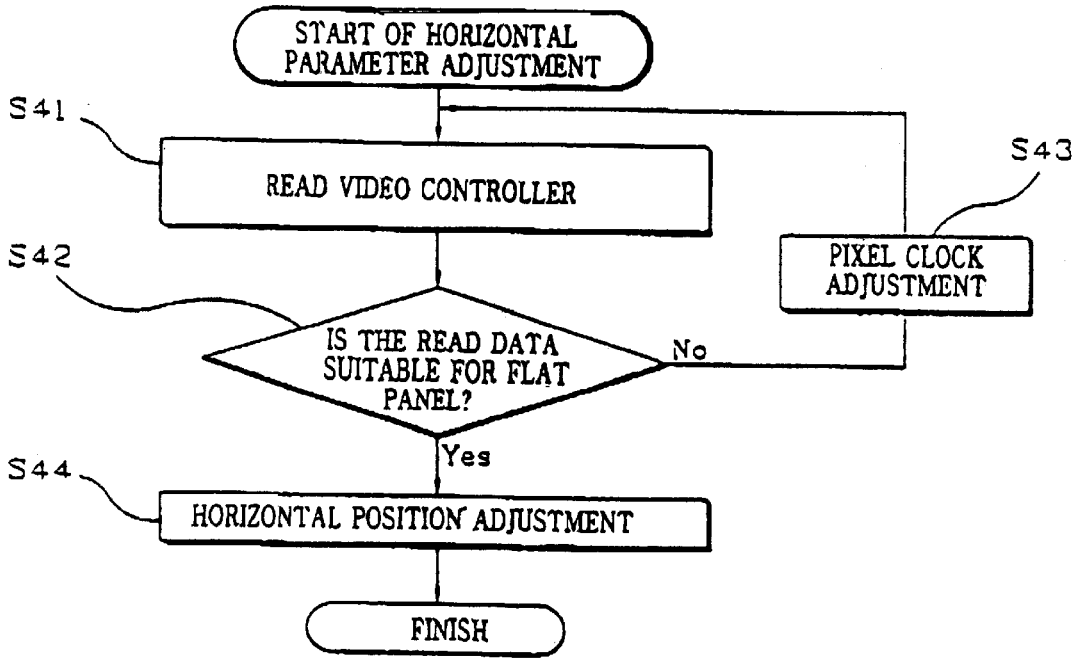
FIG. 6 is a flow chart diagram illustrating a sub-routine of a horizontal parameter adjustment of the method of FIG. 5.

As shown in FIG. 6, a sub-routine for controlling the horizontal parameter refers to the controlling of the horizontal size and position of the images.

Left and right end registers of the line memory 16*a* in the video controller 16 are read in the micro-controller 12 (S41). Then it is checked whether the first data stored in the left and right end registers are values suitable for the flat panel (S42). When the data are not the suitable values, the pixel clocks (PIXEL_CLK1) and (PIXEL_CLK2) of the first data (R1, G1, B1) are adjusted (S43). On the contrary, when the data are the suitable values, the horizontal positions of the first data (R1, G1, B1) are adjusted (S44).

Figure 7:
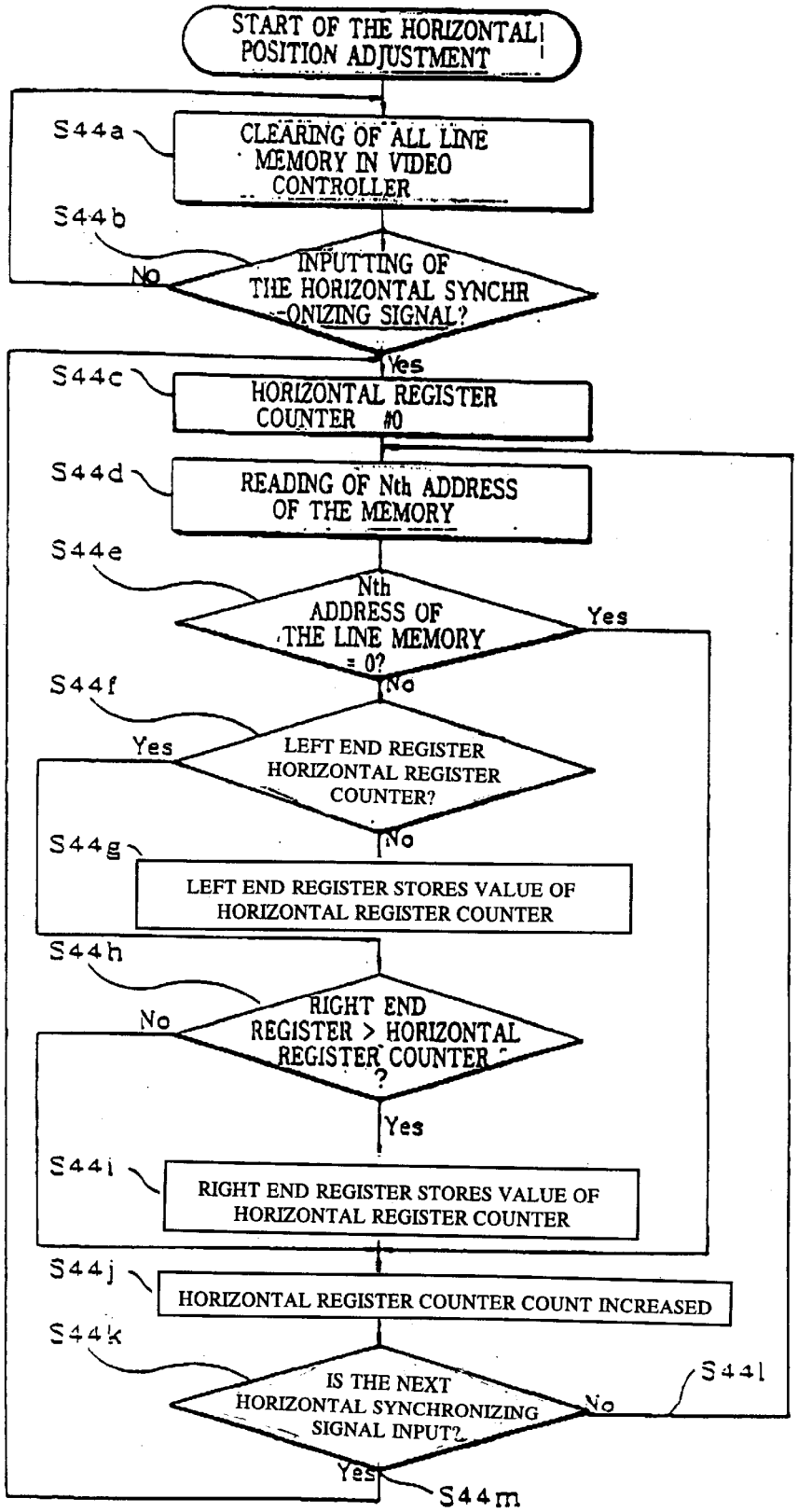
FIG. 7 is a flow chart diagram illustrating a sub-routine of a horizontal position control of the method of FIG. 6.

As shown in FIG. 7, a sub-routine for adjusting the horizontal position includes adjusting the horizontal size and position of the images of the video signals (R, G, B). First of all, all of the line memory 16*a* constituted within the video controller 16 are cleared (S44*a*). When all of the line memory 16*a* are cleared, it is checked whether horizontal synchronizing signal (H_SYNC) is input into the micro-controller 12 (S44*b*). When the horizontal synchronizing signal (H_SYNC) is input, a horizontal register counter is initialized (S44*c*). When the horizontal register counter is initialized, the Nth address of line memory 16*a* is read using the horizontal register counter (S44*d*). When the Nth address of the line memory 16*a* is read, the number of the count of the horizontal register counter is refreshed to a minimum/maximum value (S44*e*, S44*f*, S44*g*, S44*h*, S44*i*) to distinguish the first data of the offset period from the read data (first data from the active period). Specifically, it is checked whether first data are stored in the Nth address of the read line memory 16*a* when the Nth address of the line memory 16*a* is read (S44*e*). When the first data are stored in Nth address of the read line memory 16*a*, the number of the count of the horizontal register counter is refreshed to the minimum value (S44*f*, S44*g*). When the first data are stored in the Nth address, it is determined whether the address value of the left end register is greater than the address value counted by the horizontal register counter (S44*f*). When the address value of the left end register is not greater than the address value counted by the horizontal register counter, the address value counted by the horizontal register counter is stored in the left end register (S44*g*).

When the number of the count of the horizontal register counter is refreshed to the minimum value, the number of the count of the horizontal register counter is refreshed to the maximum value once again (S44*h*, S44*i*). Therein, it is determined whether or not the address value of the right end register is greater than the address value counted by the horizontal register counter (S44*h*). When the address value of the right end register is greater than the value of the address counted by the horizontal register counter, the value of the address counted by the horizontal register counter is stored in the right end register (S44*i*). As the number of the maximum count of the horizontal register counter is stored in the right end register, the start and end of the display position of the first data (R1, G1, B1) are adjusted.

And when the data are not stored in the Nth address, the number of the count of the horizontal register counter for counting the storing address of the data is increased (S44*j*) and then it is checked whether or not the next horizontal synchronizing signal (H_SYNC) is input when the horizontal register counter is increased (S44*k*).

Figure 8:
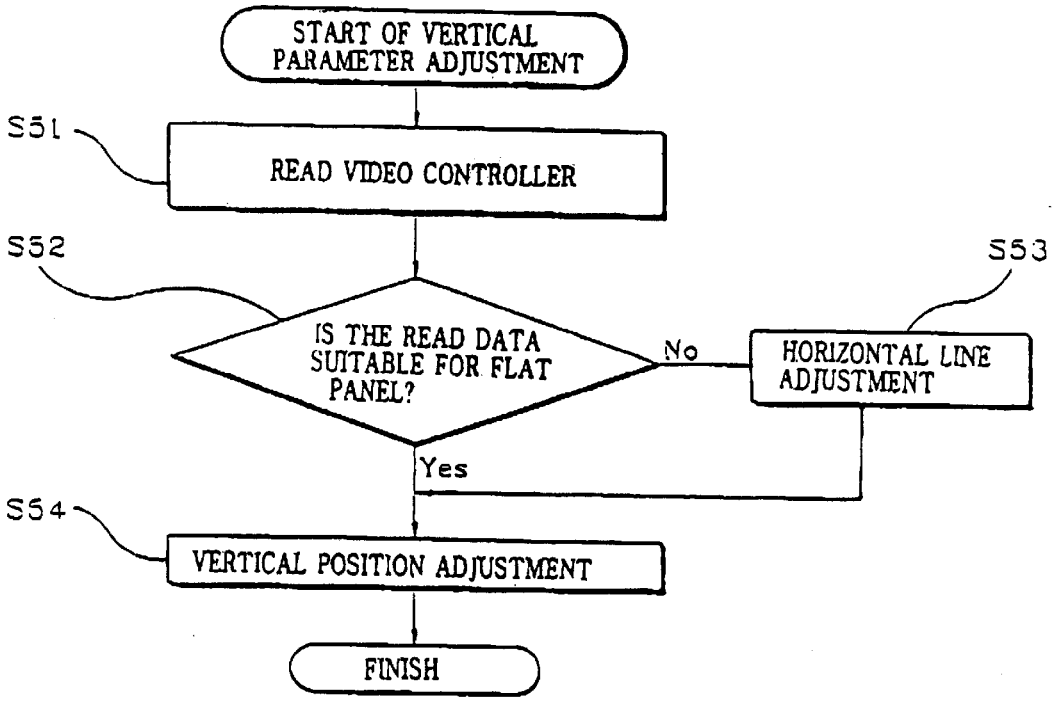
FIG. 8 is a flow chart diagram illustrating a sub-routine of a vertical parameter adjustment method shown in FIG. 5.

When the controlling of the horizontal parameter is finished, the vertical parameter of the images is controlled (S50) as shown in FIG. 8. Top and bottom end registers of the line memory 16*a* constituted in the video controller 16*a* are read in the micro-controller 12 (S51). Then it is checked whether the number of the horizontal lines of first data stored in the top and bottom end registers are a value suitable for the flat panel (S52). When the number of the horizontal lines is not suitable, the pixel clocks (PIXEL_CLK1, PIXEL_CLK2) of the first data (R1, G1, B1) are adjusted, in order to adjust the number of the horizontal lines (S53), and then the vertical positions of the first data (R1, G1, B1 are adjusted (S54). On the contrary, when the number of the horizontal lines is suitable, step S39 is not performed and the process proceeds from step S52 to step S54, wherein the vertical positions of the first data (R1, G1, B1) are adjusted (S54).

Figure 9:
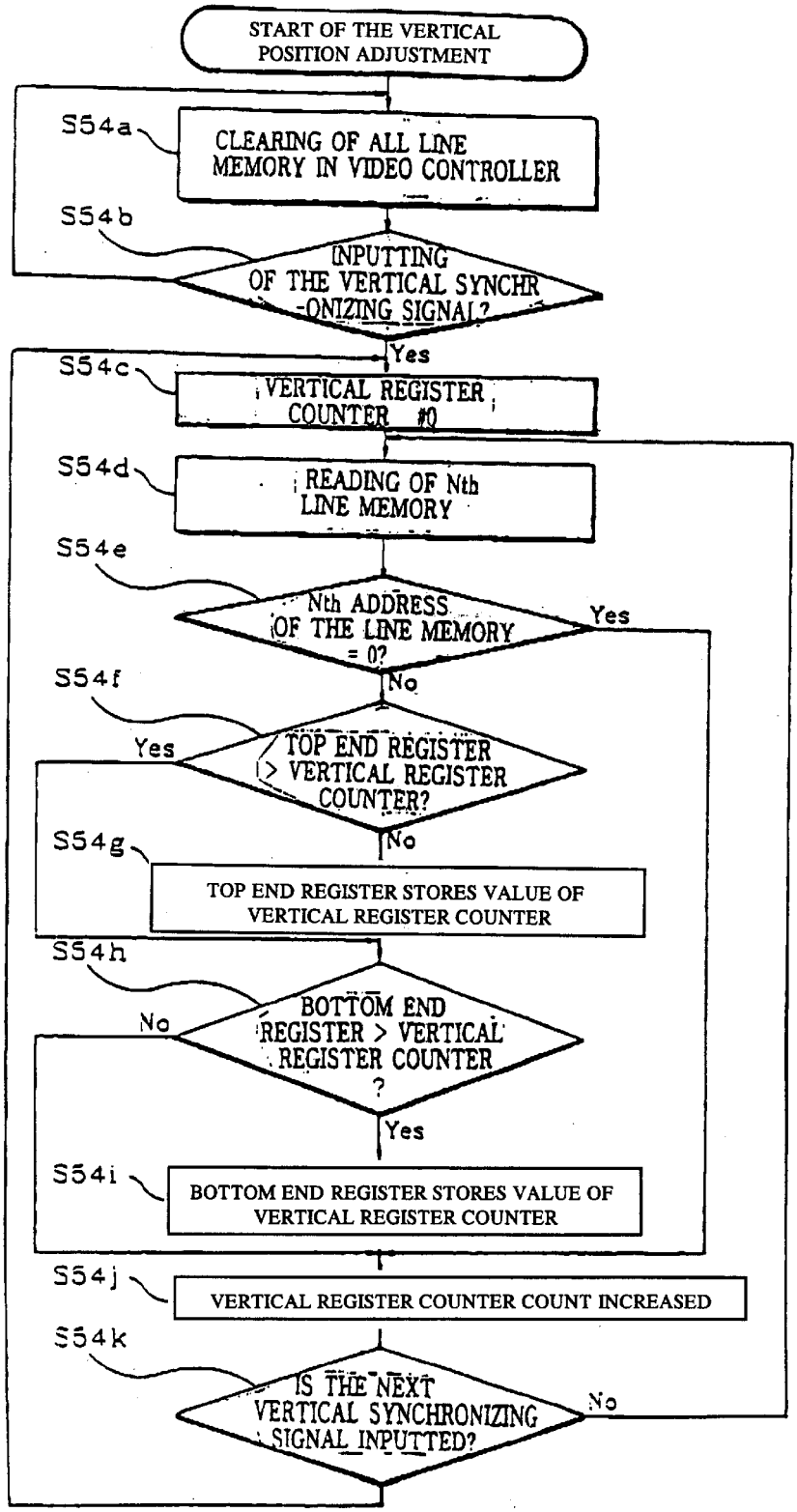
FIG. 9 is a flow chart diagram illustrating a sub-routine of a vertical position control method shown in FIG. 8.

As shown FIG. 9, a vertical position adjustment subroutine adjusts the vertical size and position of the images. First of all, all of the line memory 16*a* constituted within the video controller 16 are cleared (S54*a*). When all of the line memory 16*a* is cleared, it is checked whether the vertical synchronizing (V_SYNC) signal is input into the micro-controller 12 (S54*b*). When the vertical synchronizing signals (V_SYNC) is input, a vertical register counter is initialized (S54*c*). When the vertical register counter is initialized, the Nth address of the line memory 16*a* is read by the micro-controller 12 (S54*d*). When the Nth address of the line memory 16*a* is read, the number of the count of the vertical register counter is set to a minimum/maximum value (S54*e*, S54*f*, S54*g*, S54*h*, S54*i*).

First, it is checked whether the first data is stored in the Nth address of the read line memory 16*a* for a period of the horizontal synchronizing signal (H_SYNC) when the Nth address of the line memory 16*a* is read (S54*e*). When the first data is stored in the Nth address of the read line memory 16*a*, the number of the count of the vertical register counter is set to the minimum value (S54*f*, S54*g*). When the first data is stored in the Nth address, it is determined whether the address value of the top end register is greater than the address value counted by the vertical register counter (S54*f*). When the address value of the top end register is not greater than the address value counted by the vertical register counter, the address value counted by the vertical register counter is stored in the top end register (S54*g*).

When the number of the count of the vertical register counter is set to the minimum value, the number of the count is set to the maximum value once again. Then, it is determined to whether the value of the address of the bottom end register is greater than the address value counted by the vertical register counter (S54*h*). When the value of the address of the top end register is greater than the value of the address counted by the vertical register counter, the value of the address counted by the vertical register counter is stored in the bottom end register (S54*i*). When the value of the address counted by the vertical register counter is set to the minimum/maximum value, the number of the count of the vertical register counter is increased (S54*j*). When the vertical register counter is increased, it is checked whether the next vertical synchronizing signal (V_SYNC) is input and the next image frame is adjusted (S54*k*).

And when the first data is not stored in the Nth address in step S54*f*, the process skips to step S54*j* where the number of the count of the vertical register counter, for counting the storing address of the data, is increased (S54*j*) and then it is checked whether the next vertical synchronizing signal (V_SYNC) is input when the vertical register counter is increased and the vertical position of the images is adjusted (S54*k*).

As explained above, the present invention can also detect the timing according to modes other than the mode fixed to the flat display panel and can display the best images by automatically controlling the mode, in the case that the mode is unsuitable for the flat panel.

It will be apparent to those skilled in the art that various modifications can be made to the embodiment of the present invention, without departing from the spirit of the invention. Thus, it is intended that the present invention cover such modifications as well as variations thereof, within the scope of the appended claims and their equivalents.

What is claimed is:

1. A device for automatically controlling images represented by video signals of a flat panel display in accordance with synchronizing signals, said device comprising:

a micro-controller to discriminate modes according to the synchronizing signals, and to output an OSD (on screen display) control signal and pixel clock control signals according to the discriminated modes;

a phase-locked loop to control timing of pixel clocks according to the pixel clock control signals of said micro-controller;

an analog to digital converter to receive the video signals, to sample the video signals according to one of the pixel clocks from said phase-locked loop, and to convert the sampled video signals into digital video signals; and a video controller to receive the digital video signals transmitted from said analog-digital converter, to output the digital video signals according to the pixel clocks from the phase-locked loop and the OSD control signal from the micro-controller; and a panel driver to transfer the digital video received from the video controller to the flat panel display.

2. The device as claimed in claim 1, further comprising an OSDIC (on screen display integrated circuit) to receive the OSD control signals provided from said micro-controller, to generate OSD data to display the images according to image adjustment, and to output the OSD data to said video controller.

3. The device as claimed in claim 1, wherein said analog to digital converter adjusts sizes of the images of the video based upon the sampling of the video signals, wherein the sampling of the video signals is based upon the discriminated modes determined by said micro-controller.

4. The device as claimed in claim 1, further comprising a switching mode power supply which transmits power to the panel driver, to amplify the digital video signals output from the panel driver to a minimum level.

5. The device as claimed in claim 1, wherein said video controller comprises a line memory having columns and rows, to store the digital video signals in a received order according to the pixel clocks;

wherein a size of an amount of data of the digital video signals stored at addresses of the columns is adjusted by repeatedly adding or deleting to a frequency of the one pixel clock which is input to the analog to digital converter during the sampling of the video signals.

6. The device as claimed in claim 5, wherein if the flat panel display has a resolution greater than the video signals of the input mode, the frequency of the one pixel clock is added to, and if the flat panel display has a resolution less than the video signals of the input mode, the frequency of the one pixel clock is deleted from.

7. A device for automatically controlling images represented by video signals of a flat panel display in accordance with horizontal and vertical synchronizing signals according to a plurality of preset modes, comprising:

a processing unit to determine an input mode of the video signals according to a counted timing of the horizontal and vertical synchronizing signals, determine whether the input mode is suitable for the flat panel display, maintain the input mode of the video signals if the input mode is suitable for the flat panel display, and change the input mode to a first preset mode, of the plurality of preset modes, closest to the input mode if the input mode is not suitable for the flat panel display; and a driver displaying at least one of the input mode and the present mode video signals on the flat panel display.

8. The device as claimed in claim 7, wherein said processing unit determines whether the input mode is suitable for the flat panel display by determining if the input mode is a second preset mode.

9. The device as claim in claim 7, wherein said processing unit determines whether the input mode is suitable for the flat panel display by determining if the input mode is a second one of the plurality of preset modes.

10. A method of automatically controlling images represented by video signals of a flat panel display in accordance with horizontal and vertical synchronizing signals according to a plurality of preset modes, said method comprising:

checking whether an input mode is a first preset mode, of the plurality of preset modes, after discriminating the input mode according to a counted timing of the horizontal and vertical synchronizing signals;

driving a second preset mode, of the plurality of preset modes, nearest to the input mode in case the input mode is not the first preset mode;

controlling a horizontal parameter of the video signals according to the input mode in response to the second preset mode being driven; and controlling a vertical parameter of the video signals in response to the horizontal parameter being controlled.

11. The method as claimed in claimed in claim 10, wherein the checking comprises driving the first preset mode in response to the input mode being checked to be the first preset mode.

12. A method of automatically controlling images represented by video signals of a flat panel display in accordance with horizontal and vertical synchronizing signals according to a plurality of preset modes, said method comprising:

checking whether an input mode is a first preset mode, of the plurality of preset modes, after discriminating the input mode according to a counted timing of the horizontal and vertical synchronizing signals;

driving a second preset mode, of the plurality of preset modes, nearest to the input mode in case the input mode is not the first preset mode;

controlling a horizontal parameter of the video signals according to the input mode in response to the second preset mode being driven; and controlling a vertical parameter of the video signals in response to the horizontal parameter being controlled, wherein the controlling of the horizontal parameter comprises:

reading a left end register and a right end register in which first data of the video signals are stored and formed in a video controller, checking whether the first data stored in the left end register and the right end register read are values suitable for the flat panel display, adjusting a pixel clock of the first data in response to the first data not being the suitable values, and adjusting a horizontal position of the first data in response to the first data being the suitable values.

13. The method as claimed in claim 12, wherein the adjusting of said horizontal position comprises:

clearing all of a line memory formed within the video controller;

checking whether the horizontal synchronizing signal is input into a micro-controller in response to all of the line memory being cleared;

initializing a horizontal register counter in response to the horizontal synchronizing signal being input;

reading an Nth address of the line memory using the horizontal register counter in response to the horizontal register counter being initialized;

refreshing a number of a count of the horizontal register counter to a minimum/maximum value to distinguish the first data of an offset period of the video signals from the read first data at the Nth address of the line memory;

increasing the number of the count of the horizontal register counter to count the address, where the first data are stored, in response to the number of the count of the horizontal register counter being refreshed to the minimum/maximum value; and checking whether a next horizontal synchronizing signal is input in response to the horizontal register counter being increased.

14. The method as claimed in claim 13, wherein the refreshing of a number of a count of the horizontal register counter comprises:

checking whether the first data are stored in the Nth address of the line memory in response to the Nth address of the line memory being read;

refreshing the number of the count of the horizontal register counter to the minimum value in response to the first data being stored in the Nth address of read line memory; and refreshing the number of the count of the horizontal register counter to the maximum value in response to the number of the count of the horizontal register counter being refreshed to the minimum value.

15. The method as claimed in claim 14, wherein the refreshing of the number of the count to the minimum value comprises:

comparing whether an address value of the left end register is bigger than an address value counted by the horizontal register counter in response to the first data being stored in the Nth address; and storing the address value counted by the horizontal register counter in the left end register in response to the address value of the left end register not being bigger than the address value counted by the horizontal register counter.

16. The method as claimed in claim 15, wherein the refreshing of the number of the count of the horizontal register counter comprises:

comparing whether an address value of the right end register is bigger than an address value counted by the horizontal register counter in response to the address value of the left end register being bigger than the address value counted by the horizontal register counter; and storing the address value counted by the horizontal register counter in the right end register in response to the address value of the right end register being bigger than the address value counted by the horizontal register counter.

17. A method of automatically controlling images represented by video signals of a flat panel display in accordance with horizontal and vertical synchronizing signals according to a plurality of preset modes, said method comprising:

checking whether an input mode is a first preset mode, of the plurality of preset modes, after discriminating the input mode according to a counted timing of the horizontal and vertical synchronizing signals;

driving a second preset mode, of the plurality of preset modes, nearest to the input mode in case the input mode is not the first preset mode;

controlling a horizontal parameter of the video signals according to the input mode in response to the second preset mode being driven; and controlling a vertical parameter of the video signals in response to the horizontal parameter being controlled, wherein the controlling of the vertical parameter comprises:

reading a top end register and a bottom end register in which first data of the video signals are stored are formed in a video controller, checking whether the number of the count of horizontal lines of the first data stored in the top end register and the bottom end register are a value suitable for the flat panel display, adjusting a pixel clock for adjusting a number of a count of the horizontal lines of the first data in response to the number of the count of the horizontal lines not being the suitable value, and adjusting a vertical position of the first data by adjusting the horizontal lines in response to the first data being the suitable value.

18. The method as claimed in claim 17, wherein the adjusting of the vertical position comprises:

clearing all of a line memory formed within the video controller;

inputting the vertical synchronizing signal to a micro-controller;

initializing a vertical register counter according to the inputting of the vertical synchronizing signal to the micro-controller;

reading an Nth address of a line memory using the initialized vertical register counter;

setting the number of the count of the vertical register counter in the read Nth address of the line memory to a minimum/maximum value;

increasing the number of the count of the vertical register counter for counting the address in which first data are stored in response to the number of the count of the vertical register counter being set to the minimum/maximum value; and checking whether a next vertical synchronizing signal is input in response to the number of the count being increased.

19. The method as claimed in claim 18, wherein the setting of the number of the count of the vertical register counter comprises:

checking whether first data are stored for a period of the horizontal synchronizing signal in the read Nth address of the line memory in response to the Nth address of the line memory being read;

setting the number of the count of the vertical register counter to the minimum value in response to determining that the first data are stored in the Nth address of the line memory; and setting the number of the count of the vertical register counter to the maximum value in response to the number of the count of the vertical register counter being set to the minimum value.

20. The method as claimed claim 19, wherein the setting of the number of the count of the vertical register counter to the minimum value comprises:

comparing an address value of the top end register with the address value of the line memory counted by the vertical register counter in response to determining that the data are stored in the Nth address of the line memory; and storing the address counted by the vertical register counter in the top end register in response to the address value of the top end register not being bigger than the address value of the line memory counted by the vertical register counter.

21. The method as claimed in claim 19, wherein the setting of the number of the count of the vertical register counter to the maximum value comprises:

comparing an address value of the bottom end register with the address value counted by the vertical register counter in response to the address value of the top end register being bigger than the address value counted by the vertical register counter; and storing the address value counted by the vertical register counter in the bottom end register in response to the address of the top end register being bigger than the address value counted by the vertical register counter.

22. A method of automatically controlling images represented by video signals of a flat panel display in accordance with horizontal and vertical synchronizing signals according to a plurality of preset modes, the method comprising:

determining an input mode of the video signals according to a counted timing of the horizontal and vertical synchronizing signals;

determining whether the input mode is suitable for the flat panel display;

maintaining the input mode of the video signals if the input mode is suitable for the flat panel display and changing the input mode to a first preset mode, of the plurality of preset modes, closest to the input mode if the input mode is not suitable for the flat panel display; and displaying at least one of the input mode and the first preset mode video signals.

23. The method as claimed in claim 22, wherein the determining of whether the input mode is suitable for the flat panel display comprises:

determining whether the input mode is a second preset mode; and determining that the input mode suitable for the flat panel display if the input mode is the second preset mode.

* * * * *